US005161844A

United States Patent [19]

Zimmer et al.

[11] Patent Number: 5,161,844

[45] Date of Patent: Nov. 10, 1992

[54] PROCESS AND GRASPING DEVICE FOR PICKING UP, TRANSPORTING, AND DEPOSITING FLAT PARTS MADE OF TEXTILE MATERIAL, ETC.

[75] Inventors: Herr D. Zimmer, Friedberg; Günther Weichhard, Augsburg, both of Fed. Rep. of Germany; Jens Hensel, Utica, Mich.

[73] Assignee: Kuka Schwessanlagen & Roboter GmbH, Fed. Rep. of Germany

[21] Appl. No.: 580,269

[22] Filed: Sep. 7, 1990

[30] Foreign Application Priority Data

Oct. 6, 1989 [DE] Fed. Rep. of Germany ... 8911949[U]

[51] Int. Cl.[5] ..... B65H 3/22

[52] U.S. Cl. ..... 294/61; 271/18.3

[58] Field of Search ..... 294/61; 271/18.3, 19, 271/20; 901/31, 39; 414/736, 741, 771

[56] References Cited

U.S. PATENT DOCUMENTS

| | | | |
|---|---|---|---|
| 3,386,763 | 6/1968 | Ottaway et al. | 294/61 |
| 4,645,193 | 2/1987 | Walton et al. | 271/18.3 |
| 4,679,784 | 7/1987 | Porat et al. | 294/61 X |

FOREIGN PATENT DOCUMENTS

| | | | |
|---|---|---|---|
| 3223241 | 8/1983 | Fed. Rep. of Germany . | |
| 3331093 | 3/1985 | Fed. Rep. of Germany . | |
| 3327758 | 3/1987 | Fed. Rep. of Germany . | |
| 3540032 | 5/1987 | Fed. Rep. of Germany . | |
| 9004559 | 5/1990 | World Int. Prop. O. | 271/18.3 |

*Primary Examiner*—Margaret A. Focarino
*Assistant Examiner*—Dean J. Kramer
*Attorney, Agent, or Firm*—McGlew & Tuttle

[57] ABSTRACT

The present invention pertains to processes and gripping devices for picking up, transporting, and depositing flexible, limp, flat workpieces (1) made of textile material, plastic, or other materials that can be grasped with needles (3). To handle such workpieces (1) rapidly and reliably even under complicated spatial conditions, needle grippers (2) are brought by a manipulating device (5) into a position parallel to the workpiece (1) and, after grasping the workpiece (1), into another position in which the horizontal projection of the workpiece is reduced and in which the workpiece (1) assumes an approximately loop-like shape, in which position the workpiece (1) is transported and deposited.

11 Claims, 5 Drawing Sheets

PROCESS AND GRASPING DEVICE FOR PICKING UP, TRANSPORTING, AND DEPOSITING FLAT PARTS MADE OF TEXTILE MATERIAL, ETC.

FIELD OF THE INVENTION

The present invention pertains to gripping devices and to a process for picking up, transporting, and depositing flat work pieces made of textile material, plastic, or other materials that can be grasped by means of needles, and are the gripping device being provided with needle grippers which can be moved by a manipulating device and whose needles can be introduced into the work piece in groups and obliquely, in mutually diverging directions in order to grasp and transport the flat work pieces.

BACKGROUND OF THE INVENTION

Needle grippers of this type have been known from West German Utility Patent No. DE-GM 88,11,030. Here, two needle bars that can be moved obliquely relative to the vertical direction are arranged in a housing Each needle bar carries on its outer surface needles arranged congruently to the axis of movement, and the axes of movement of the two needle bars are arranged in opposite directions relative to the vertical direction.

SUMMARY AND OBJECTS OF THE INVENTION

The present invention is based on the application of this prior-art needle gripper and it is an object of the invention to make the grasping, moving, and depositing of flat work pieces made of textile material, plastic, or other materials that can be grasped with such needles so mechanical that rapid, collision-free operation will become possible even under complicated spatial conditions which hinder free movement of the part.

According to the present invention a process is provided in which the individual needle grippers are brought into a position parallel to the work piece for picking up or releasing the work piece and, after grasping the part, they are brought into another position which reduces the horizontal projection of the work piece in which the work piece is transported and deposited.

According to an alternative to this process, the work piece is first grasped and lifted at one of its edges with a first group of needle grippers. After this step the needle gripper group with the grasped edge is moved to the opposite edge of the part, which is now grasped and lifted with a second group of needle grippers. The work piece is then transported while maintaining the workpiece in a loop-like, hanging position.

A device according to the present invention, which carries out this process, is characterized in that the individual needle gripper (2) is connected—directly or indirectly—rotatably or pivotably to the hand (4) of an industrial robot (5). The needle gripper can be brought by a motor from a pick-up or depositing position, that is parallel to the work piece (1), into a pivoted position reducing the horizontal projection of the part, in which position the work piece (1) is transported and deposited.

It is assumed that the work pieces are made available for grasping one by one or in a stack. For this purpose, needle grippers are therefore moved to a position parallel to the work pieces and are brought into the grasping position. This makes it possible to lift the individual work piece from its support or from the next part. However, the work piece should not be transported to the depositing position in its flat state. Instead partial areas of the work piece are turned up or down from its flat position, so that they assume a smaller horizontal projection in the state as transported. The advantage of this measure is that the work piece thus deformed can be passed through openings whose cross sections are smaller than the dimensions of the flat part.

The automatic insertion of floor covers into the body of motor vehicles, e.g., into the trunk space, on one hand, and into the passenger compartment, on the other hand, shall be mentioned as an example of such a manipulating operation. It would not be possible to place the floor cover cut to size, into these spaces in the flatly extended state, as the door openings for the trunk space and the passenger compartment are narrower than the width of the floor covers. On the other hand, manipulating the work pieces according to the present invention offers the advantage that the load of the work pieces can be picked up more easily during transportation, because the horizontal projection of the work pieces is substantially reduced by the turning. The ability of the needle grippers to hold the work piece is thus also improved, because the work piece is grasped by the needle grippers in a more or less vertical position, and the needles extending upward in this position have a particularly reliable holding function.

Even though it has been known from West Germany Utility Patent No. DE-GM 7,640,840 that needle grippers can be hinged on pivotably mounted levers, according to this state of the art, the needles are in a vertical position relative to the surface of the work piece to be grasped. The swiveling adjustment of the levers in the form of a parallelogram rod system has the task of stretching the work piece into which the needles have penetrated along its plane in order to offer a firm resistance to the needles, which is needed for transporting the part. The needles now remain in their vertical position, as a consequence of which the work piece cannot, with certainty, be prevented from sliding off the needles, and it should also be borne in mind that the work piece is tensioned and therefore it can easily be damaged.

Advantageous embodiments of the present invention include a holder, on which is firmly connected to the hand of the industrial robot. The connecting rods carrying the needle grippers are pivotably mounted on the holder and can be pivoted with a motor.

An independent variant of the present invention is disclosed, in which a rod-like holder for groups of needle grippers is connected to the hand of the industrial robot and can be rotated or pivoted together with it. Thus, the individual needle gripper is no longer arranged on a connecting rod, but participates in the rotary or pivoting movement of the hand of the industrial robot or the rod-like holder. This makes it possible to grasp a flat work piece first in one edge zone, after which an arc- shaped movement of the work piece grasped in a partial area is performed in order to grasp the other edge of the part. The work piece thus grasped more or less envelopes the rod-like holder with the needle grippers, which opens up the possibility of transporting the work piece thus held along the axis of the holder and thus passing the work piece holder even through small openings.

The application of the present invention is not limited to automotive engineering. There are numerous examples of application in connection with the insertion of flat workpieces into housing-like components, e.g., the lining of machine housings with insulating material for vibration absorption and muffling of noises.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DETAILED DESCRIPTION OF THE PREFERRED EMBODIMENTS

Figure 1:
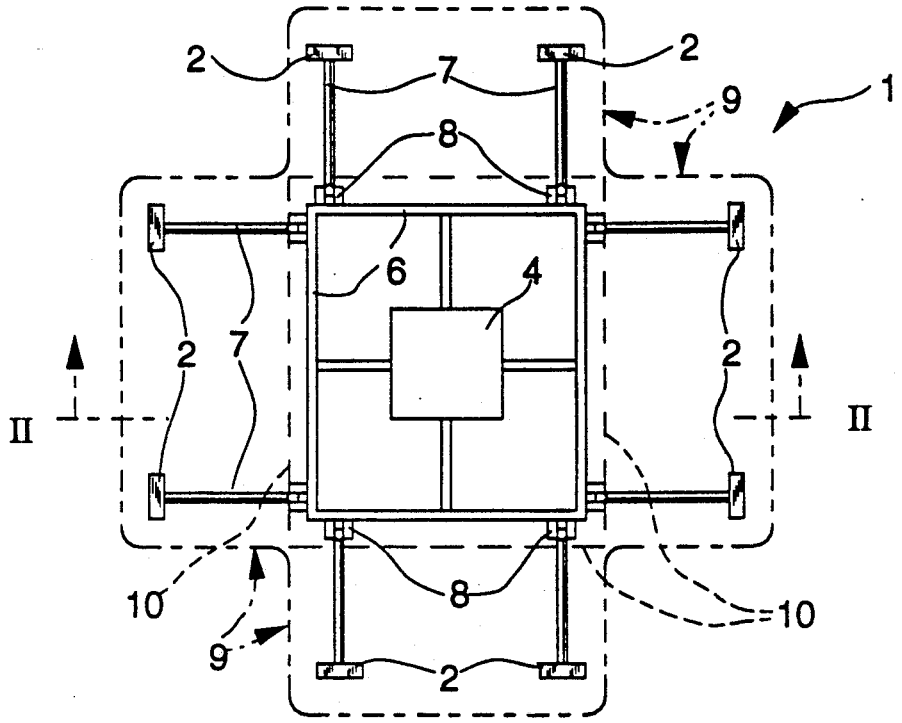
FIG. 1 is a top view of a holder held by the hand of an industrial robot with needle grippers mounted pivotably on it.

Referring to the drawings and in particular to the embodiment shown in FIG. 1, a work piece 1 is provided shown as a horizontal projection. The workpiece is a cut such that it deviates from the rectangular shape by various incisions. Partial areas 9 are thus formed, which can be turned up or down in various directions around imaginary axes 10. Such a work piece may be, e.g., the floor cover for a trunk space of a motor vehicle. However, it is also imaginable that the workpiece 1 will be used to line the inner surfaces of a parallelepipedal housing.

The material of the workpiece usually consists of textiles; however, it is also possible to use plastics or other materials that can be grasped with needles.

A hand of an industrial robot is shown, schematically and is designated by reference numeral 4. A holder 6, which has a frame-like character, is fastened to this hand. Pivot bearings 8 for rotatably mounting connecting rods 7, whose free ends carry needle grippers 2, are located on the holder 6. The connecting rods 7 can be rotationally adjusted by a motor.

With its connecting rods 7 and the needle grippers 2, the holder 6 covers the flat workpiece 1 spread out over a large surface area and is brought with its needle grippers 2 to the workpiece so that the needle grippers 2 will assume a position parallel to the workpiece 1. Such a position is shown, for example, in FIG. 3 for an individual needle gripper which has needles 3 which can be adjusted to an oblique position from the vertical direction relative to the surface of the workpiece 1 and which needles have angular positions and adjusting axes displaced from the vertical direction. The extended position of the individual needles 3 is shown in the example in FIG. 4. It can be seen that the needles penetrate obliquely into the workpiece 1. If the needle gripper 2 is lifted in this position shown in FIG. 4, the workpiece or the grasped partial area 9 of the workpiece is also lifted by the needle gripper 2 without the workpiece being able to slide off the needles 3.

Figure 3:
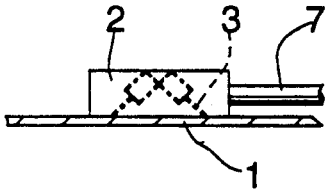
FIGS. 3 and 4 are schematic side views of individual needle grippers in two different working positions.
Figure 4:
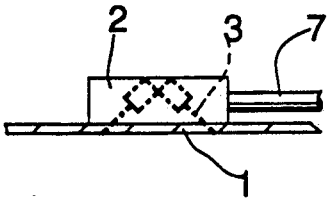

The representations in FIGS. 3 and 4 are merely schematic. Instead of individual needles 3, it is also possible to provide needle pairs. However, it is also possible to design needle grippers 2 according to the previously published West German Utility Patent No. DE-GM 88,11,030.8. Therefore, it is not necessary to explain the design and the function of the needle grippers 2 according to the present invention in greater detail.

Figure 6:
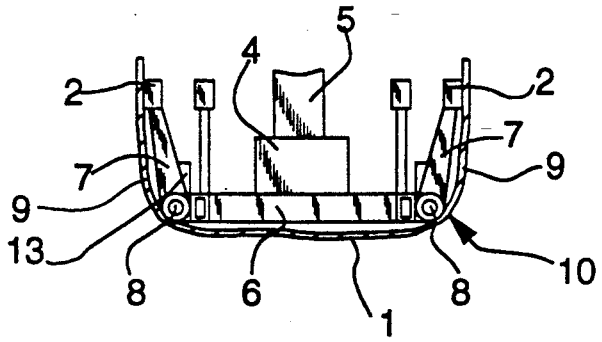
FIGS. 6 and 7 ar side views of pivotably mounted needle grippers in different working positions.

FIG. 6 shows the workpiece 1 in its ready-to-transport position, and it is recognizable that the connecting rods 7 have been swiveled into a vertical position around the pivot bearings 8 and thus have grasped partial areas 9 of the workpiece 1. Part of an industrial robot, which holds the hand 4, to which the frame-like holder 6 is attached, is symbolically designated by reference numeral 5.

A workpiece 1 thus deformed can be placed, through an opening, from the top, e.g., into a trunk space of a motor vehicle, whose opening is smaller than the horizontal projection of the spread-out workpiece 1. After the workpiece 1 has come to lie on the floor of the trunk, the connecting rods 7 are pivoted back into the position which is needed for pressing on or bonding the workpiece to opposing surfaces.

The present invention also comprises the reversal of the above-described movements. Thus, it is imaginable that the center of the workpiece 1 is grasped by means of needle grippers, using the hand 4 of the industrial robot or with a central area of the holder 6, and the partial areas 9 are additionally also grasped by the needle grippers 2 connected to the connecting rods 7. When the hand 4 of the industrial robot is raised, the workpiece 1 is first moved upward in its flat position, after which the connecting rods 7 can swing downward, so that the workpiece 1, which is being held in its central area, can be transported as a bell-shaped hood. This measure is particularly suitable when the workpiece 1 is to be used to cover a body projecting upward in the form of a punch.

Figure 5:
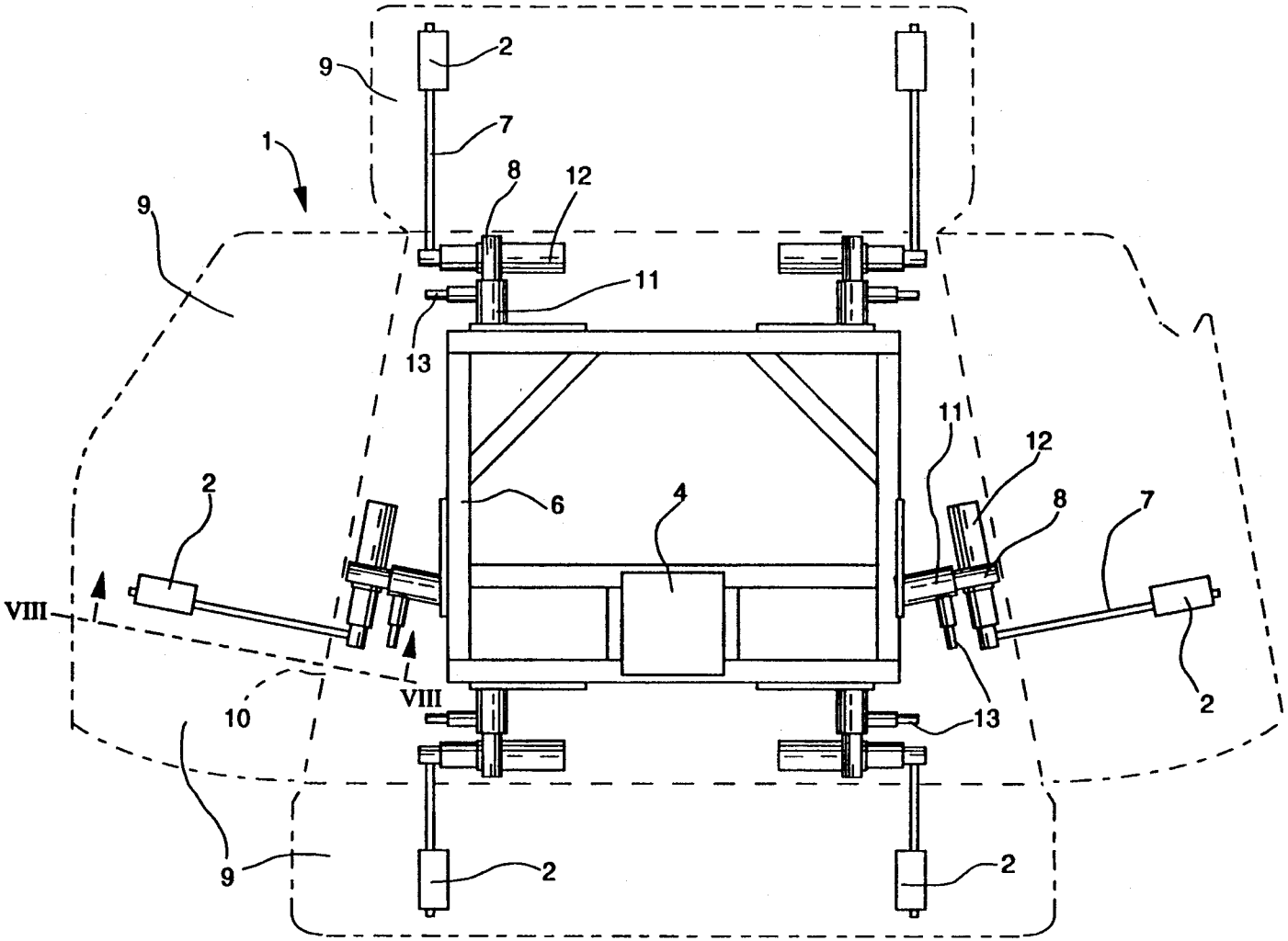
FIG. 5 is a top view of a variant of a frame-like holder according to FIG. 1.

The embodiment according to FIG. 5 shows a variant of FIG. 1. It can be seen in FIG. 5 that the connecting rods 7 can be mounted pivotably around mutually oblique axes on the holder 6. Thus, the workpiece 1 has oblique pivot axes 10 for the partial areas 9. To achieve this, correspondingly obliquely directed bracket arms 11, which carry the pivot bearings 8 for the connecting rods 7, are fastened to the holder 6. Pivoting motors 12, on whose journals the connecting rods 7 are arranged, are mounted in the pivot bearings 8. The connecting rod 7 can thus be pivoted by the motor 12, and held in a corresponding position in a simple manner. To limit the pivot angle, stops 13 are provided on the bracket arm 11 or the holder 6.

Figure 8:
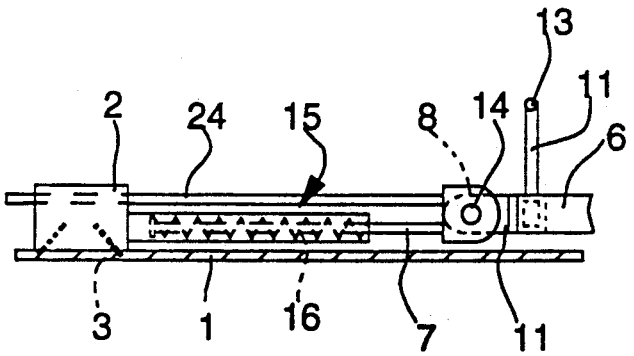
FIG. 8 is a side view of a telescoping connecting rod for the needle grippers along line VIII—VIII in FIG. 5 on a larger scale.

Because the axis of rotation of the connecting rods 7 is usually different from the approximate pivot axis 10 of the workpiece 9 to be moved of the workpiece 1, jamming may occur between the workpiece 1 and the needle gripper 2 held by the connecting rod during the pivoting movement. To avoid these disadvantageous effects, it is recommended that the connecting rods 7 be designed as telescoping rods. One example of this is shown schematically in FIG. 8, according to which the connecting rod 7 is designed as a telescoping rod, one part of which is connected to the needle gripper 2 and the other part of which is connected to the axis 14 of the pivot bearing 8. A spring 16 acts between the two parts. The spring 16 returns the connecting rod parts 7 into their starting position as soon as the force acting on the telescoping rod 15 from the outside decreases. An additional guide rod 24 may be used to prevent the needle gripper 2 from rotating.

Such a telescoping arrangement is also able to compensate for differences in dimensions which may frequently occur among different vehicle types.

Figure 2:
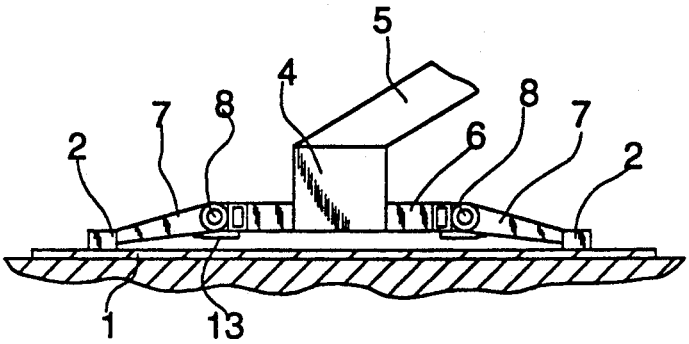
FIG. 2 is a vertical section through the arrangement according to FIG. 1 taken along line II—II of FIG. 1.
Figure 7:
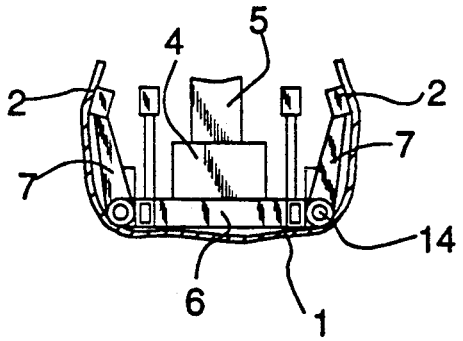

The embodiment in FIGS. 6 and 7 shows a variant in which the workpiece 1 can be brought by means of connecting rods 7 arranged in pairs from a flat position according to FIGS. 2 and 5 into a position according to FIG. 7, in which it envelopes the holder 6 and the connecting rods 7. Such an arrangement is advantageous if the workpiece 1 is to assume the smallest possible space for transportation and is to be moved through relatively small openings. The hand 4 of the industrial robot 5 is now designed such that it can be moved with the workpiece 1 enveloping it practically perpendicularly to the plane of the drawing.

Figure 9:
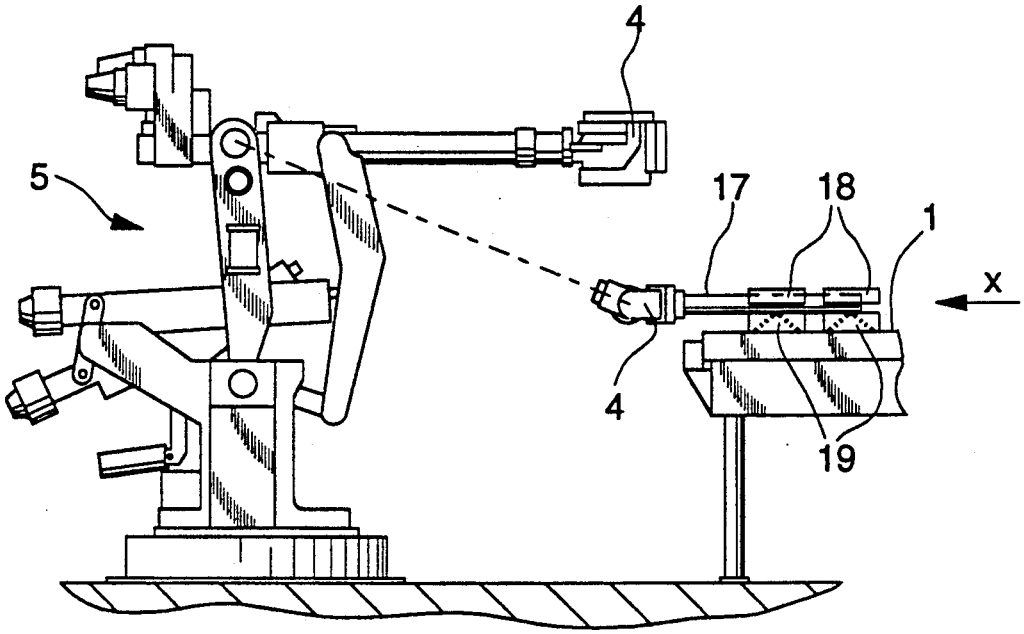
FIG. 9 is a side view of an industrial robot with a rod-like holder held by it.
Figure 10:
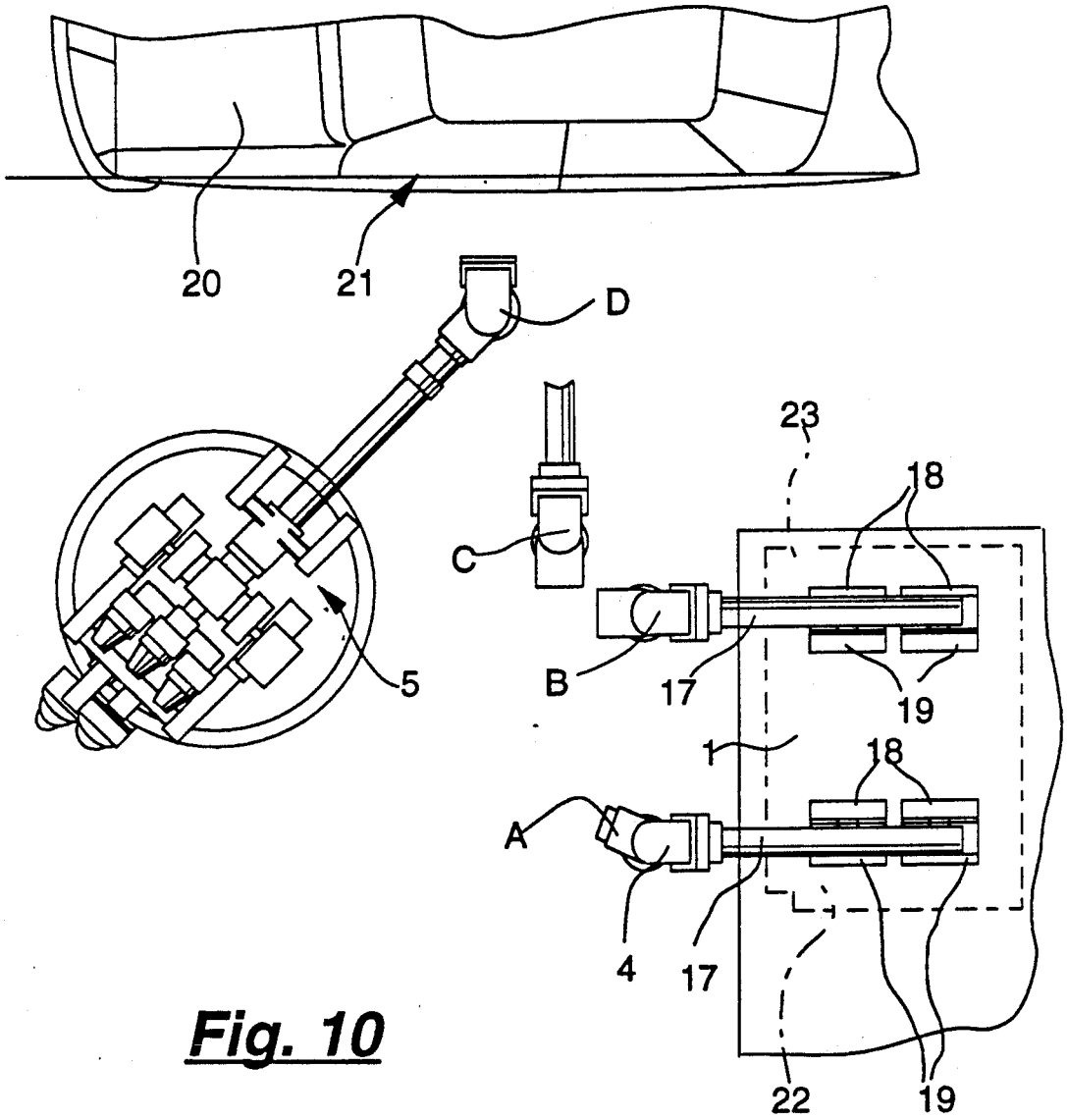
FIG. 10 is a top view of the arrangement according to FIG. 9 in different working positions of the industrial robot; and, FIG. 11 is a front view of the rod-like holder according to arrow X in FIG. 9.

The embodiment according to FIGS. 9 and 10 is independent from the above-described embodiments.

FIG. 9 shows a conventional industrial robot 5 with a hand 4, to which a rod-like holder 17 is connected, e.g., bolted. Consequently, the rod-like holder 17 participates in the movement of the hand 4 and can thus be rotated around the axis of the hand 4, pivoted around the articulated axis of the hand 4, and moved with the hand 4 as a consequence of the other possibilities of movement of the industrial robot.

Figure 11:
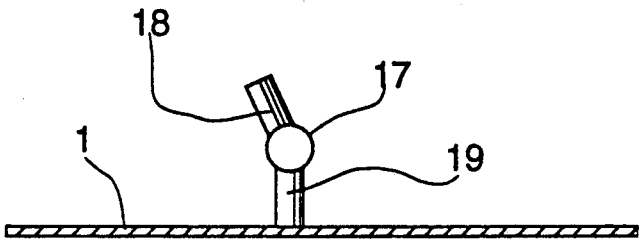

Two needle gripper groups 18, 19, whose action directions are angularly staggered around the axis of rotation of the rod-like holder 17, as is apparent, e.g., from FIG. 11, are located on the rod-like holder 17. As is apparent from the example in FIG. 10, the needle gripper group 19 is about to grasp the edge zone 22 of the workpiece 1. The needles of this needle gripper group 19 are directed downward, toward the workpiece 1. The other needle gripper group 19 with its needles points upward or to one side, and therefore it does not participate in the grasping of the edge zone 22 of the workpiece 1. In position A, the needle gripper group 19 is parallel to the workpiece 1 or its edge zone 22 and is able to grasp the workpiece 1 in this area.

The hand 4 of the industrial robot 5 is subsequently raised with the rod-like holder 17 and moved toward position B to grasp the other edge zone 23 of the workpiece 1. During this displacement, the rod-like holder 17 with the hand 4 is rotated around the longitudinal axis of the holder 17 until the hitherto nonparticipating needle gripper group 18 reaches the parallel position to the edge zone 23 of the workpiece 1. During this movement, the previously grasped edge zone 22 of the workpiece 1 is carried and it forms an arc, so that the rod-like holder 17 is surrounded by the workpiece 1 at a spaced location. When the two needle gripper groups 18, 19 enclose an angle of, e.g., 180° with each other, the rod-like holder 17 is enveloped by the workpiece 1 approximately in the shape of a U after the second edge zone 23 has been grasped.

From this position B, the hand 4 of the workpiece holder is pivoted around its own articulated axis into position C and also displaced into position D in the direction of a vehicle 20, in such a way that the rod-like holder 17 with the workpiece 1 being held by the needle gripper groups 18, 19 can be introduced into a vehicle 20 through its side door opening 21. This introduction of the workpiece is controlled such that one of the edge zones 22 or 23 of the workpiece 1 is brought into the end position intended for deposition. The associated needle gripper group 18 or 19 is released there, so that the associated edge zone 22 or 23 comes into contact with the floor parts of the vehicle. The hand 4 with the rod-like holder 17 is subsequently moved sideways and rotated at the same time until the other needle gripper group 18, 19 has brought the associated edge zone 22, 23 into the other end position of the workpiece 1 on the floor of the vehicle. The other needle gripper group 18 or 19 is then released there, after which a retracting movement of the rod-like holder 17 from the side door opening 21 of the vehicle 20 can take place.

While specific embodiments of the invention have been shown and described in detail to illustrate the application of the principles of the invention, it will be understood that the invention may be embodied otherwise without departing from such principles.

What is claimed is:

1. A gripping device for picking up, transporting and depositing flat workpieces, each workpiece being formed of textile material, plastic or other materials which can be grasped with needles and having a dimension in an extended position which is larger than an opening of a target structure into which the workpiece is to be deposited, comprising: gripping means including a first needle gripper having needles arranged in groups and pointing in directions substantially away from one another and a second needle gripper including needles arranged in groups pointing in directions substantially away from one another, said gripping means for gripping said workpiece; manipulating means connected to said gripping means for moving said first needle gripper and said second needle gripper with a grasped workpiece, said manipulating means for moving said first needle gripper relative to said second needle gripper to move a first edge zone of said workpiece to a location adjacent a second edge zone of said workpiece to position said workpiece in a looped position with an arched middle zone to transport said workpiece through said opening of said target structure, said manipulating means being adjustable to a dimension smaller than said opening of said target structure and for extending said workpiece into said extended position within said target structure; and said first needle gripper and said second needle gripper are carried by connecting rods, said connecting rods being pivotably mounted on a frame like holder including a motor for rotating said connecting rods, said frame like holder being connected to said manipulating means including a hand of an industrial robot, said frame-like holder includes stops provided to limit the pivoting movement of the connecting rod.

2. A gripping device according to claim 1, wherein said connecting rods are connected to said frame-like holder by laterally projecting bracket arms, said motor being provided for a pivoting drive of said connecting rods and being positioned in said bracket arms, parallel to a pivot axis of a partial area of the workpiece, said partial area being foldable about said pivot axis.

3. A gripping device according to claim 1, wherein said connecting rods are mounted in pairs pivotable around mutually parallel axis, said needle grippers being driven in opposite directions such that a grasped workpiece can be moved such that it envelopes the connecting rods and said motor.

4. A gripping device according to claim 1, wherein said manipulating means and associated said first and second needle gripper are dimensioned for automatically inserting floor covers into trunks of motor vehicles.

5. A gripping device for picking up, transporting and depositing flat workpieces made of textile material, plastic or other materials that may be grasped with needles, each workpiece having a dimension in an extended position which is greater than an opening of a target structure into which the workpiece is to be deposited, comprising: industrial robot means including a hand for rotational and pivotal movement; a rod-like holder connected to said hand and rotatable with said hand; a first needle gripper including needles extending in groups and pointing in directions away from one another and a second needle gripper including needles extending in groups and pointing in directions away from one another, said first and second needle grippers being connected to said rod-like holder for movement into a first angular position for grasping an edge zone of said workpiece with said first needle gripper and movable into a second angular position for grasping said workpiece at another edge zone for lifting said workpiece to form a looped shape having a dimension smaller than the opening of said target structure; and said industrial robot means has means for moving the rod-like holder together with first the needle gripper into an edge zone position parallel to the workpiece at said edge zone of said workpiece, said first needle gripper grasping the workpiece at said edge zone; means for displacing the rod-like holder from said edge zone position in the direction of another edge zone of the workpiece and simultaneously rotating said rod-like holder around its axis until the second needle gripper reaches a parallel position to said another edge zone which is still in a flat position, said second needle gripper grasping the workpiece at said another position; means for moving said rod-like holder with the grasped workpiece to a position suitable for releasing the workpiece along the rod-like holder's longitudinal axis; means for detaching one of the first and second needle gripper from the workpiece; and means for displacing and rotating the rod-like holder with respect to its axis into another depositing position for detaching another of said first and second needle gripper from the workpiece in said another depositing position. d 6. A gripping device according to claim 5, wherein said workpiece which is held by needle gripper groups can be brought into a position in which it envelopes said rod-like holder at least partially along a central axis of said rod-like holder.

7. A gripping device according to claim 5, wherein said groups of said first and second needle grippers have working directions displaced relative to one another.

8. A gripping device according to claim 5, wherein said holder and industrial robot hand are dimensioned for automatically inserting a floor cover into a passenger compartment of a motor vehicle.

9. A process for picking up, transporting and laying down flat workpieces having a horizontal dimension of a defined size in an extended position, the workpiece being formed of textile material, plastic or other materials that can be grasped with needles of a manipulating device, comprising the steps of:

(A) providing needle graspers whose needles extend in groups in directions pointing away from one another and grasping the material with the needle graspers;

(B) moving edge zones of the workpiece that are located opposite one another toward one another with said needle graspers to bring said workpiece into a looped form with an arched middle zone;

(C) transporting said workpiece to a target structure including passing said workpiece in said looped form through an opening of said target structure, said opening having a maximum dimension smaller than a dimension of said extended workpiece, to position said workpiece within said target structure, said workpiece being moved by a support adjustable to a dimension to pass through said opening;

(D) at said target structure moving said edge zones of said workpiece into said extended position; and (E) detaching said needle graspers from said edge zone of said workpiece.

10. A process for picking up, transporting, and setting down flat workpieces made of textile material, plastic or other materials that can be grasped with needles of a manipulating device, the workpiece having a dimension in an extended position, the process comprising the steps of:

(A) providing needle graspers with needles extending in groups and pointing in directions away from one another and grasping an edge zone of the workpiece with said needle grasper and lifting said edge zone;

(B) moving the needle grasper with said edge zone in a direction of an opposite edge zone of the workpiece to position said workpiece in a looped shape with said edge zone and said opposite edge zone located substantially opposite to one another and with an arched middle zone of said workpiece;

(C) grasping another edge zone of said workpiece in said looped shape with another needle grasper and lifting said workpiece in said looped shape by said another needle grasper;

(D) transporting said workpiece in said looped shape along a central axis of said looped shape including passing said workpiece in said looped form through an opening of said target structure, said opening having a maximum dimension smaller than a dimension of said extended workpiece, to position said workpiece within said target structure, said workpiece being moved by a support adjustable to a dimension to pass through said opening;

(E) setting one of said workpiece edge zones down at a target and detaching said needle grasper from said one of said edge zones;

(F) displacing the other of said edge zones laterally until said workpiece is provided in said extended position; and (G) subsequently to positioning said workpiece in said extended position, detaching said other of said edge zones from said needle grasper.

11. A gripping device for picking up, transporting and depositing flat workpieces, each workpiece being formed of textile material, plastic or other materials which can be grasped with needles and having a dimension in an extended position which is larger than an opening of a target structure into which the workpiece is to be deposited, comprising: gripping means including a first needle gripper having needles arranged in groups and pointing in directions substantially away from one another and a second needle gripper including needles arranged in groups pointing in directions substantially away from one another, said gripping means for gripping said workpiece; manipulating means connected to said gripping means for moving said first needle gripper and said second needle gripper with a grasped workpiece, said manipulating means for moving said first needle gripper relative to said second needle gripper to move a first edge zone of said workpiece to a location adjacent a second edge zone of said workpiece to position said workpiece in a looped position with an arched middle zone to transport said workpiece through said opening of said target structure, said manipulating means being adjustable to a dimension smaller than said opening of said target structure and for extending said workpiece into said extended position within said target structure; and said first needle gripper and said second needle gripper are carried by connecting rods, said connecting rods being pivotably mounted on a frame like holder including a motor for rotating said connecting rods, said frame like holder being connected to said manipulating means including a hand of an industrial robot, said connecting rods supporting said needle grippers being mounted in pairs pivotable around mutually parallel axis, said needle grippers being driven in opposite directions such that a grasped workpiece can be moved such that it envelopes the connecting rods and said pivoting motors, said connecting rods being designed as telescoping elastic connecting rods.

* * * * *